US006769342B2

(12) United States Patent
Oetlinger

(10) Patent No.: US 6,769,342 B2
(45) Date of Patent: Aug. 3, 2004

(54) CLAMP PIECES FOR LOWER FRAME ASSEMBLY OF BLANKING TOOL

(75) Inventor: Frank E. Oetlinger, Grafton, WI (US)

(73) Assignee: Blanking Systems, Inc., Grafton, WI (US)

( * ) Notice: Subject to any disclaimer, the term of this patent is extended or adjusted under 35 U.S.C. 154(b) by 6 days.

(21) Appl. No.: 10/078,864

(22) Filed: Feb. 20, 2002

(65) Prior Publication Data

US 2003/0154837 A1 Aug. 21, 2003

(51) Int. Cl.[7] ..... B26D 7/26; B31B 1/14
(52) U.S. Cl. ..... 83/699.31; 83/859; 493/74
(58) Field of Search ..... 83/103, 859, 701, 83/699.31, 698.41, 698.51, 698.61, 698.71; 225/97; 493/73, 76, 74; 403/393, 110

(56) References Cited

U.S. PATENT DOCUMENTS 4,131,047 A * 12/1978 Schriber et al. ..... 83/698.31
4,187,753 A * 2/1980 Walde ..... 83/698.41 X
4,913,016 A 4/1990 Frei ..... 83/13
4,920,843 A * 5/1990 Stromberg et al. ... 83/698.41 X

FOREIGN PATENT DOCUMENTS

CA 2287035 4/2001

* cited by examiner

*Primary Examiner*—Charles Goodman
(74) *Attorney, Agent, or Firm*—Boyle Fredrickson Newholm Stein & Gratz S.C.

(57) ABSTRACT

A frame assembly for a lower blanking tool of a carton die cutting machine. The frame assembly includes a rigid outer frame, an inner grid comprised of a plurality of lengthwise and crosswise extending bars, and a plurality of clamp devices attaching the bars to the outer frame. Each clamp device includes an upright plate member in which is formed a substantially U-shaped upper cavity. A wedge is disposed within the cavity for sliding movement between clamped and released positions to rigidly hold the ends of the bars of the inner grid to the outer frame. In an alternate embodiment, the clamp has an upper and lower cavity together with upper and lower wedges which are simultaneously moved between clamped and released positions.

16 Claims, 6 Drawing Sheets

CLAMP PIECES FOR LOWER FRAME ASSEMBLY OF BLANKING TOOL

BACKGROUND OF THE INVENTION

The present invention relates to die cutting machines for making carton blanks, and more particularly to a frame assembly for a lower blanking tool that supports carton scrap during a blanking operation in a die cutting machine.

In the manufacture of cartons, small sheets of paper material having specific profiles are cut out of larger sheets of paper material. These smaller sheets are known as carton blanks which, in turn, are formed into cartons and/or boxes. The blanks are formed during a process known as a blanking operation in a die cutting machine.

In a die cutting machine, the blanks are cut, but not removed from a large sheet of paper material. After the blanks have been cut, the sheet is moved downstream in the die cutting machine to a blanking station where the sheet is positioned over a frame assembly for support. The frame assembly includes an outer frame and an inner grid having large openings which correspond in size, in shape and in position to the profile of the carton blank previously cut. Below the frame is a mechanism for stacking the carton blanks.

At the blanking station, an upper tool is used in combination with the lower tool or frame assembly to knock the carton blanks from the sheet of paper material while holding the scrap material that surrounds the blanks. The upper tool has a support board that moves vertically up and down in the die cutting machine, and the support board typically has a plurality of stand-offs depending therefrom that hold pushers spaced beneath the board which in turn are used to push the carton blanks from the sheet through the lower tool or frame assembly. A plurality of presser assemblies are also mounted in the support board and depend therefrom to hold the scrap material against the lower tool or frame assembly during the blanking operation so that the blanks may be pushed from the sheet. A presser assembly typically includes a presser rail which is biased downwardly away from the support board by a spring so that the rail is positioned slightly below the pushers. As the upper tool is lowered, the presser rail engages the sheet of paper material first such that a scrap portion of the large sheet of material is secured between the presser rail and the frame. The upper tool then continues to be lowered such that the sheet of material engages the inner grid within the frame while at substantially the same time the pushers engage the carton blanks and knock the blanks out of the sheet of material and through the inner grid. The carton blanks then fall into a stacking mechanism below the frame where the blanks are stacked for further processing.

The lower tool used in the blanking operation is typically comprised of a steel outer frame that supports an inner grid. The inner grid is typically comprised of a plurality of lengthwise and crosswise extending bars. In order to secure the inner grid in place on the outer frame, the end of each bar is typically screwed onto attachment pieces which in turn are mounted on the lengthwise and crosswise rails of the outer frame. Since the frame and grid support a sheet of paper material during the blanking operation, the grid must be configured to match or conform to the die cut in the sheet of paper material. In addition, the grid must be reconfigured whenever a different carton blank needs to be produced. Thus, unscrewing the inner grid from the outer frame oftentimes becomes very cumbersome and time consuming. Thus, it is desirable to provide a quicker manner of attaching and removing the inner grid from the outer frame.

Other types of attachment pieces include wedges which are used to clamp the ends of the bars in place. Although these wedges provide a type of quick-connect and quick-disconnect for the bars of the grid, they also have the disadvantage of oftentimes moving the bars slightly during assembly. Movement of the bars, even slight movements thereof, result in the grid being misaligned with the die cut in the sheet of paper material which in turn may result in an imprecise blanking operation.

SUMMARY OF THE INVENTION

It is an object of the present invention to provide an improved frame assembly for a lower blanking tool of a carton die cutting machine.

It is another object of the present invention to provide a frame assembly for a lower blanking tool that includes an inner grid that may be easily attached and removed from its supporting outer frame, can be precisely positioned during assembly, and yet maintains its rigidity during normal blanking operations.

It is yet another object of the invention to provide a frame assembly for a lower blanking tool which is easy to assemble, compatible with standard blanking operation machinery, and relatively inexpensive.

In order to accomplish the above objects, the present invention provides a frame assembly for a lower blanking tool of a carton die cutting machine. The frame assembly includes a rigid outer frame, and an inner grid comprised of a plurality of lengthwise and crosswise extending bars for supporting a sheet of die cut paper material during a blanking operation. The frame assembly also includes a plurality of clamps attaching the ends of the bars of the inner grid to the outer frame. Each clamp comprises an upright plate member defining a substantially flat vertically extending inner face, a substantially flat opposite vertically extending outer face, and a horizontally extending upper face. A substantially U-shaped upper cavity is formed in the inner face of the plate member and opens at its upper end to the upper face. The upper cavity defines an upper abutment surface, an opposite downwardly sloped surface disposed at an acute angle with respect to the upper abutment surface, and an upper support surface. An upper wedge member is disposed within the upper cavity for sliding movement along the downwardly sloped surface between clamped and released positions. The upper wedge is also substantially U-shaped and defines a clamping surface disposed parallel to and spaced from the upper abutment surface, an opposite downwardly angled surface disposed to engage against and slide along the downwardly sloped surface of the U-shaped upper cavity, and a base surface disposed substantially parallel to and spaced from the upper support surface of the cavity when the wedge member is in its clamped position. A screw extends through the upper wedge member into the upper support surface and is used to move the upper wedge between its clamped and released positions so as to hold or clamp the end of a bar of the inner grid between the abutment surface of the upper cavity and the clamping surface of the wedge member.

In another aspect, the invention includes the clamping device itself for attaching the bars of an inner grid to the outer frame of the lower blanking tool of a carton die cutting machine. The clamping device includes the upright plate member, U-shaped upper cavity and upper wedge member described above. However, in an alternate embodiment, the clamping device may also include a lower U-shaped cavity and a lower wedge member disposed within the lower cavity for sliding movement along an upwardly sloped surface between clamped and released positions. The lower cavity is preferably a mirror image of the upper cavity, and is used to clamp a bar of the inner grid at two points rather than only a single point if only the upper cavity and upper wedge is utilized. This is particularly useful to attach the lengthwise or machine direction bars of the inner grid as these bars may be taller than the crosswise bars.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENT

Figure 1:
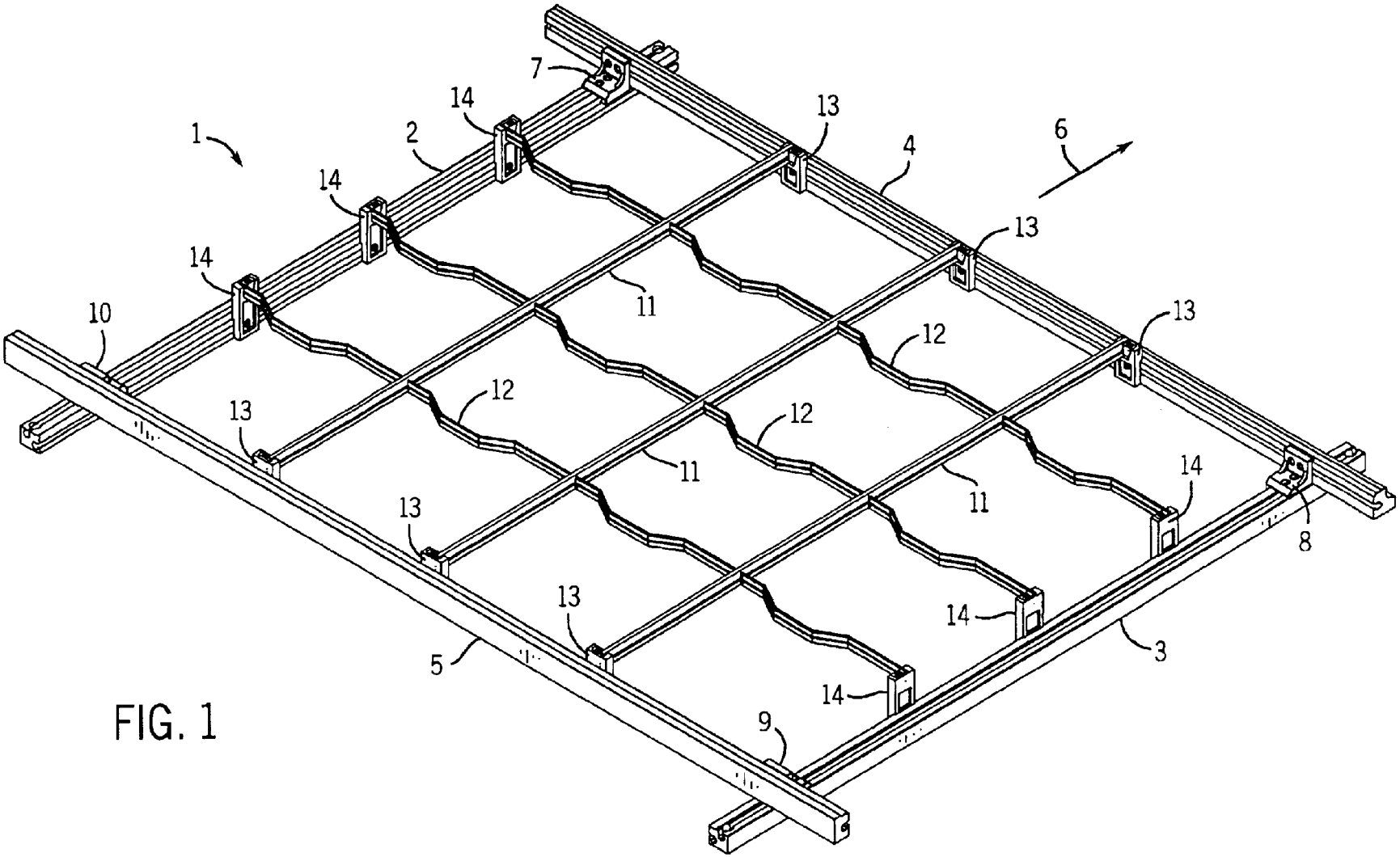
FIG. 1 is a perspective view of a lower frame assembly for a blanking tool of a carton die cutting machine constructed in accordance with the principles of the present invention.

Referring now to the drawings, FIG. 1 illustrates a lower frame assembly generally designated by the numeral 1 which is used in a blanking tool of a die cutting machine for converting or processing a sheet of paper material into a carton blank. These machines are well known in the art and are used to cut one or several blanks into each sheet of paper material which, after folding and gluing, may be formed into cartons or boxes. As is conventional, the sheets of paper material move in a substantially horizontal plane within the machine and are carried through various sequences of printing, cutting, embossing, creasing, waste stripping and/or blanking stations.

The die cutting machine usually is formed by a series of stations with the first station being a starting position or input station in which the sheets, which may be preprinted if desired, are taken one by one from the top of a stack to a feed table where they are placed in position against frontal and side guides. The sheet can then be grasped by a gripper bar and lead downstream or in the machine direction into subsequent processing stations. Typically, the sheet is first conveyed into a cutting station where the carton or box blanks of a desired size and profile are die cut into the sheet. These blanks are held to the sheet by knicks which are arranged along the cut edges of the blanks. This cutting station is usually comprised of upper and lower tools, one of which is provided with a plurality of line-shaped straight and curved die cutting blades. If desired, the cutting station may be proceeded by a printing station, or as noted above, the sheets may be preprinted. After cutting, the sheet is then lead to a stripping station where the waste, i.e. the unused scrap between the various blanks, are grasped by upper and lower pins in order to be lead downward into a waste container. The sheet is then fed to a blanking station where the sheet is positioned horizontally over a lower frame for support. The lower frame includes an inner grid having large openings which correspond in size, in shape and in position to the profile of the blank previously cut. An upper blanking tool having one or more presser assemblies mounted thereto then moves vertically downwardly in the die cutting machine to secure the scrap portions against the grid and frame and then as the tool continues to move downwardly, the fasten points or knicks between the blanks and the sheet are broken by pushers so that each of the blanks are released, pushed through the grid and falls below the frame where the blanks are stacked for further processing. Finally, the residual or remaining portion of the sheet is carried into a delivery or exit station where it is released by the gripper bar as waste material.

Referring now to FIG. 1, there is illustrated frame assembly 1 for a lower blanking tool of a carton die cutting machine. The lower frame assembly 1 includes an outer frame comprised of a pair of opposite, spaced apart longitudinally extending side frame members or side rails 2 and 3, and a pair of opposite, spaced apart cross frame members or cross rails 4 and 5 extending crosswise between side rails 2 and 3. Arrow 6 illustrates the machine direction, i.e. the direction of movement of a sheet of paper material (not shown) within the die cutting machine. Thus, as illustrated in FIG. 1, side rail 2 would be considered the left side rail while side rail 3 would be considered the right side rail. Likewise, cross rail 4 would be considered the front or leading cross rail while cross rail 5 would be considered the rear or trailing cross rail. As illustrated, cross rails 4 and 5 each have a length such that their opposite ends overlap the opposite ends of side rails 2 and 3. Also, cross rails 4 and 5 are disposed on top of side rails 2 and 3 so that the lower surface of cross rails 4 and 5 abut against the upper surfaces of side rails 2 and 3, as will hereinafter be described.

Side rails 2 and 3 are rigidly interconnected to cross rails 4 and 5 by means of a plurality of corner pieces 7–10. Corner pieces 7 and 9 are referred to herein as right corner pieces while corner pieces 8 and 10 are referred to herein as left corner pieces. The terms "right" and "left" refer to the location of a tenon on the underside of each corner piece (see FIG. 7 versus FIG. 11), but it should be noted that left corner pieces 8 and 10 are essentially mirror images of right corner pieces 7 and 9. Corner pieces 7–10 are used to rigidly interconnect rails 2–5 to one another, and function like clamps to tightly hold rails 2–5 together in a "square" or 90° relationship, as will hereinafter be described.

The inner grid is composed of a plurality of parallel lengthwise bars 11 extending in the machine direction between front rail 4 and rear rail 5, and a plurality of substantially parallel crosswise bars 12 extending transversely to the machine direction 6 between left rail 2 and right rail 3. Bars 11 and 12 of the inner grid can be point welded or glued with adhesive at the points where they intersect to insure rigidity of the inner grid. Bars 11 are attached to cross rails 4 and 5 by means of a plurality of attachment pieces or clamp devices 13. Likewise, bars 12 are attached to side rails 2 and 3 by a plurality of attachment pieces or clamp devices 14. It should be noted that the present invention is not limited to the design for the inner grid illustrated in FIG. 1 as the design illustrated is but one example of an inner grid design. In fact, the profile of the inner grid is typically changed depending upon the type, size and shape of the carton blank to be produced. Thus, the inner grid illustrated in FIG. 1 is for illustration purposes only.

Figure 11:
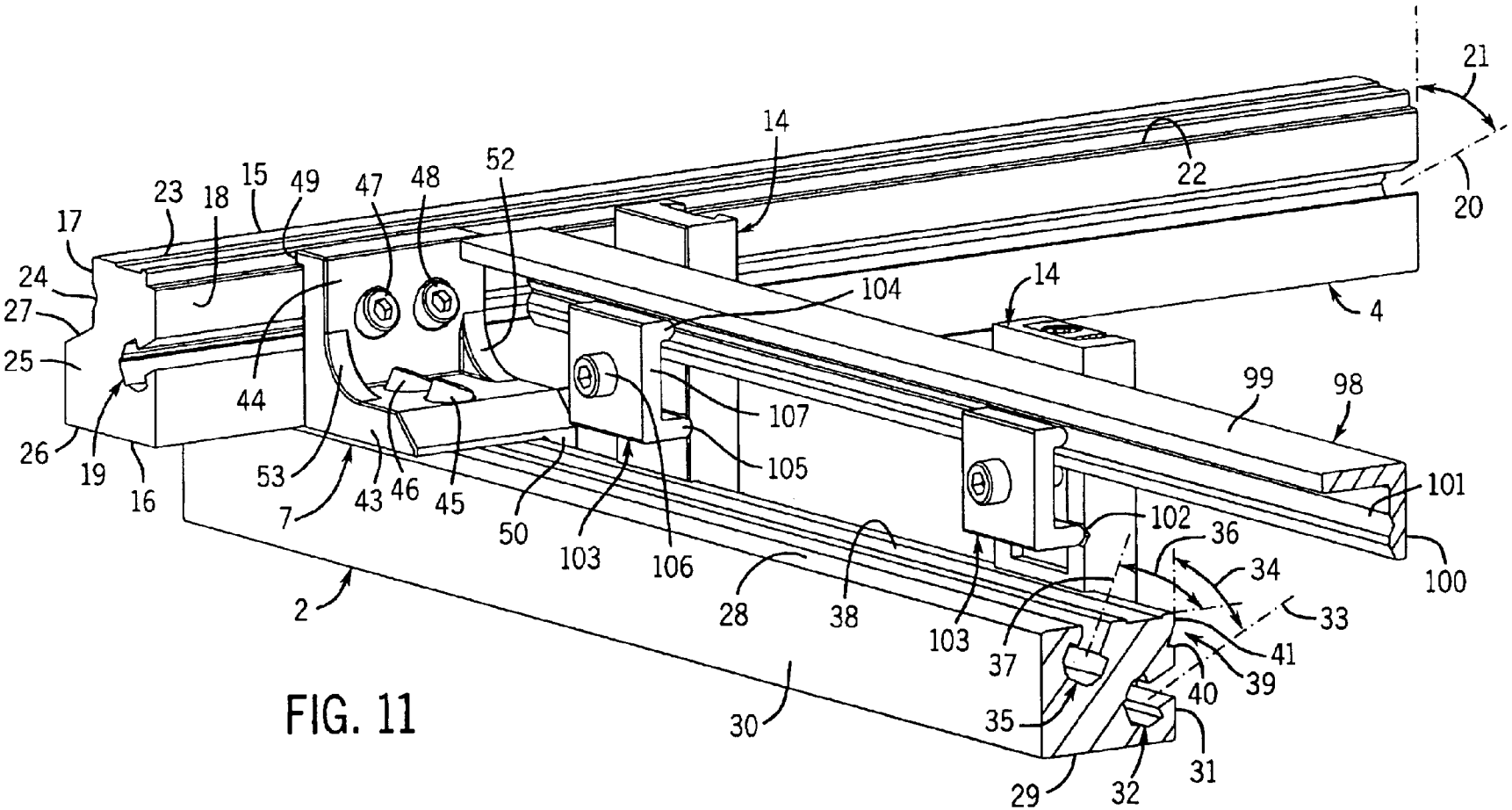
FIG. 11 is a perspective view, partially in section, illustrating a stiffening assembly for a side rail of the outer frame.

Referring now to FIG. 11, there is illustrated in more detail the interconnection of left side rail 2 to front cross rail 4 by corner piece 7. More specifically, cross rail 4 includes an upper surface 15, an opposite lower surface 16, an outer surface 17, and an opposite inner surface 18. Each surface 15–18 is substantially planar, and surface 18 is referred to as the "inner" surface since it faces the interior of frame assembly 1, i.e. towards the inner grid. As shown best in FIG. 11, rail 4 includes a bolt receiving T-shaped slot 19 formed therein. Slot 19 is formed throughout the entire elongate length of rail 4 and opens to both of the opposite ends of rail 4. Slot 19 has a blind end located within the interior of rail 4 and has an open end which opens to inner surface 18. Slot 19 defines a downwardly extending axis 20 disposed at an acute angle 21 with respect to the plane of inner surface 18. As shown in FIG. 11, acute angle 21 is defined as the angle between axis 20 and the plane of inner surface 18. Acute angle 21 may be an angle between 1° and 89°, but is preferably an angle of about 30° to about 80°, and most preferably an angle of about 65°.

As shown in FIG. 11, rail 4 also includes an inwardly projecting ledge 22 formed in inner surface 18. Ledge 22 is planar in shape and is disposed at an angle of 90° with respect to inner surface 18. However, ledge 22 could also be modified to be at an acute angle with respect to inner surface 18 if desired. As shown, ledge 22 is located at the intersection of the upper surface 15 and inner surface 18 of rail 4 such that ledge 22 is located between upper surface 15 and T-shaped slot 19. Ledge 22 extends along the entire length of rail 4 and opens to both of the opposite ends of rail 4 in a manner similar to slot 19.

Rail 4 further includes a channel-shaped recess 23 formed in upper surface 15. Recess 23 is formed and extends along the entire length of rail 4 and opens to both of the opposite ends of rail 4. Recess 23 is typically utilized to receive a ruler or other measuring device which aids in the proper placement of attachment members or clamp devices 13 and 14 when building the inner grid.

Rail 4 also includes a V-shaped cavity 24 formed in its outer surface 17. Again, as with slot 19, ledge 22 and recess 23, cavity 24 is formed along the entire length of rail 4 and opens to both of the opposite ends of rail 4. Typically, each face of cavity 24 is formed at a 60° angle to a horizontal line running through the center thereof. The function of cavity 24 is to locate a linear scale for measuring placement of the bars 11, 12 for the inner grid.

Front cross rail 4 also includes a reinforcement or stiffening member 25 which minimizes the flexing of rail 4 during a blanking operation. Reinforcement member 25 projects outwardly from outer surface 17 and is formed along the entire length of rail 4. Although illustrated as being integral with rail 4, reinforcement member 25 could also be a separate piece which could be removably attached with fasteners if desired. Also, although illustrated as having a lower surface 26 contiguous with lower surface 16 of rail 4 and a chamfered surface 27 contiguous with outer surface 17, reinforcement member 25 could take other shapes and be positioned in a slightly different location than illustrated so long as it functions to stiffen front cross rail 4.

The cross sectional profile of rear cross rail 5 is identical to front cross rail 4 with the exception that rail 5 does not include the reinforcement or stiffening member 25. Since rail 5 is identical to rail 4 with the exception of reinforcement member 25, like numbers, except utilizing the designation "A" therewith, are utilized to refer to like parts or elements.

As illustrated, cross rails 4 and 5 are elongated members having opposite ends and a length greater than either its height or its width. Rail 5 and rail 4 (without reinforcement member 25) have a height greater than their width, and are formed of aluminum, preferably extruded aluminum. Extrusion techniques provide the most efficient and cost effect method of producing an aluminum rail having the profile illustrated in FIG. 11.

Referring now to FIGS. 1 and 11, there is illustrated the cross sectional profile of side rails 2 and 3. The profiles of rails 2 and 3 are identical, and therefore only one will be described, i.e. side rail 2. As illustrated, side rail 2 is an elongate member having a length greater than either its height or its width. However, rail 2 has a width which is slightly greater than its height which enables it to accommodate the additional slot to hereinafter be described. Again, as with rails 4 and 5, rails 2 and 3 are composed of aluminum, preferably extruded aluminum. As illustrated, rail 2 has an upper surface 28, an opposite lower surface 29, an outer surface 30 and an opposite inner surface 31. Surfaces 28–31 are substantially planar in shape and are formed along the entire length of rail 2 and extend completely between opposite ends of rail 2. As shown best in FIG. 11, rail 2 includes a bolt receiving T-shaped slot 32 formed therein throughout the entire length thereof. Slot 32 defines a downwardly extending axis 33 disposed at an acute angle 34 with respect to the plane defined by inner surface 31. Acute angle 34 may be any angle between 1° and 89°, but is preferably between about 30° to about 80° and is most preferably about 65°. Slot 32 has a blind end located within rail 2 and has an open end which opens to inner surface 31. Slot 32 is formed along the entire length of rail 2 and is open to both of the opposite ends of rail 2.

As shown in FIG. 11, rail 2 further includes a second bolt receiving T-shaped slot 35 formed therein. Slot 35 is identical to slot 32 in shape and also defines a downwardly extending axis 36 disposed at an acute angle 37 with respect to upper surface 28. As with angle 34, acute angle 37 may be any angle between about 1° to about 89°, but is preferably between about 30° to about 80° and most preferably about 65°. Slot 35 is formed along the entire length of rail 2 and opens to both of the opposite ends of rail 2. As illustrated, slot 35 has a blind end located within rail 2 and an open end which opens to upper surface 28. The blind end of slot 35 (as well as the blind end of slots 19 and 32) is configured to conform to the shape of a nut (not shown) captured therein. The nut is utilized to threadedly receive and hold the shank of a bolt extending into slot 35 (as well as slots 19 and 32), as will hereinafter be described.

As illustrated, rail 2 also includes a channel-shaped recess 38 formed in upper surface 28. Recess 38 is formed in upper surface 28 between slot 35 and inner surface 31, and functions to receive a ruler or other measuring device to aid in building the inner grid in a manner similar to recess 23 in rails 4 and 5. Recess 38 is formed throughout the entire length of rail 2 and opens to both of the opposite ends thereof.

As shown best in FIG. 11, rail 2 also includes an angled groove 39 formed in inner surface 31 above slot 32. Again, groove 39 is formed through the entire length of rail 2 and opens to both of the opposite ends thereof. As illustrated, groove 39 includes an inwardly projecting ledge 40, and an angled surface 41. Ledge 40 has a planar surface and is disposed at an angle of about 90° with respect to inner surface 31. Other acute angles for ledge 40 may be used, but 90° is preferred. Angled surface 41 forms an acute angle with ledge 40 which angle is generally between about 30° to about 80°, but is preferably about 70°. Groove 39 functions to receive a tenon of corner piece 7 as will hereinafter be described.

Corner piece 7 is also illustrated in FIG. 11. As noted earlier, corner piece 7 is identical to corner piece 9 while corner pieces 8 and 10 are mirror images thereof. More specifically, corner piece 7 interconnects side rail 2 and front cross rail 4 of the lower blanking tool frame assembly, and includes an L-shaped body having a horizontal plate member 43 and an upright or vertical plate member 44. Horizontal plate member 43 defines a substantially flat upper face, a substantially flat opposite lower face, an inside face, an opposite outside face and an end face. As illustrated, each of these faces are substantially planar in shape. Upright or vertical plate member 44 also defines a substantially flat inner face contiguous with the upper face of plate member 43, a substantially flat outer face contiguous with the lower face of plate member 43, an inside face contiguous with the inside face of horizontal plate member 43, an opposite outside face contiguous with the outside face of horizontal plate member 43, and a top face. Horizontal plate member 43 has a pair of adjacent, aligned outwardly and downwardly extending bolt receiving bores formed therethrough extending between its upper face and lower face. Each bore defines an axis disposed at an acute angle with respect to the upper face of plate member 43. The acute angle may be between about 1° and 89°, but preferably between about 30° and about 80°, and most preferably about 65° to match angle 37 of slot 35.

Upright or vertical plate member 44 also includes a pair of adjacent, aligned outwardly and downwardly extending bolt receiving bores formed therethrough from its inner face to its outer face through which bolts 47 and 48 extend into T-shaped slot 32. Each bore defines an axis disposed at an acute angle with respect to the inner face of plate member 44. Again, this acute angle may be anywhere between 1° and 89°, it is preferably between about 30° and about 80°, and is most preferably about 65° to match angle 34 of slot 32.

Upright plate member 44 has a lip 49 projecting outwardly therefrom. Lip 49 has an upper surface and a lower surface. The upper surface of lip 49 is contiguous with the top face of plate member 44 while its lower surface is contiguous with the outer face of plate member 44. Lip 49 is disposed substantially 90° with respect to the outer face of plate member 44, and lip 49 extends completely across the outer face of plate member 44. Although illustrated as being contiguous with the top face of plate member 44, lip 49 could also be spaced slightly downwardly therefrom if desired. Also, lip 49 need not necessarily extend completely across the outer face of plate member 44, but preferably does so to provide the maximum amount of clamp force against ledge 22, as will hereinafter be described.

Corner piece 7 also includes a tenon 50 projecting downwardly from horizontal plate member 43. Tenon 50 has an angled surface disposed at an acute angle with respect to the lower face of plate member 43. This acute angle may be any angle between 1° and 89°, but preferably matches the angle formed by surface 41 of groove 39 in side rail 2. Again, by matching the angle of surface 41 the maximum amount of friction is provided between tenon 50 and surface 41 to provide the maximum clamping force, as will hereinafter be described. Finally, corner piece 7 includes a pair of reinforcement members or blocks 52 and 53 located at the intersection of upright plate member 44 and horizontal plate member 43. As shown best in FIG. 11, each block 52, 53 preferably comprises a wedge-shaped or triangular-shaped member.

Left corner pieces 8 and 10 are mirror images of right corner pieces 7 and 9, and therefore need not be described herein in detail, but identical parts utilize like numerals with the designation "A" therewith. Corner pieces 8 and 10 are referred to as "left" corner pieces since tenon 50A is located on the left side thereof. In like manner, corner pieces 7 and 9 are referred to as "right" corner pieces since tenon 50 is located along the right side thereof. In all other respects, corner pieces 8 and 10 are identical to corner pieces 7 and 9.

In order to assemble frame assembly 1, cross rails 4 and 5 are placed on top of side rails 2 and 3 so that the ends of rails 2–5 overlap one another, as illustrated in FIG. 1. Thereafter, right corner piece 7 is placed as illustrated in FIG. 11 with lip 49 engaging ledge 22 in cross rail 4, and tenon 50 engaging groove 39 formed in side rail 2. Bolts 45 and 46 are then inserted through the bores in plate member 43 into corresponding nuts contained in slot 35 of side rail 2. As bolts 45 and 46 are tightened, they engage the nuts to pull or clamp cross rail 4 tightly against side rail 2. At the same time, bolts 47 and 48 extend through the bores of upright plate member 44 into nuts captured within slot 19 of cross rail 4. As bolts 47 and 48 are tightened, they pull or clamp the upper surface 29 of side rail 2 tightly against the lower surface 16 of cross rail 4. In this manner, rails 2 and 4 are rigidly interconnected. Thereafter, in a like manner, corner pieces 8–10 are utilized to rigidly interconnect the other three corners of frame assembly 1. As a result, rails 2–5 are rigidly interconnected to one another to form frame assembly 1.

As illustrated best in FIG. 1, the second T-shaped slot 32 formed in inner surface 41 of side rails 2 and 3, is utilized to connect a plurality of attachment pieces or clamp pieces 14 for crosswise bars 12 of the inner grid. In like manner, the T-shaped slots 19 and 19A formed in cross rails 4 and 5, are also utilized to connect attachment pieces or clamp devices 13 for mounting lengthwise bars 11 of the inner grid.

Figure 2:
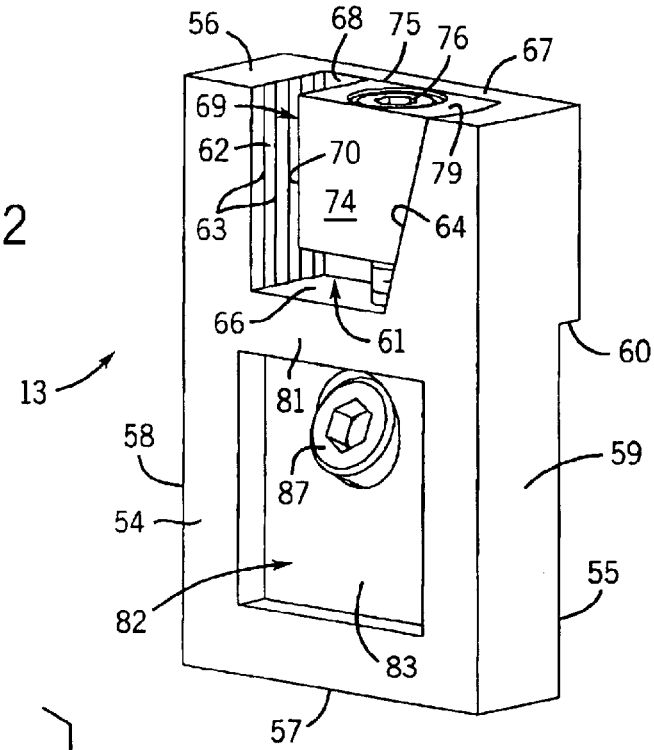
FIG. 2 is an enlarged perspective view illustrating a clamp device for attaching a bar of the inner grid to the outer frame of the lower frame assembly.
Figure 3:
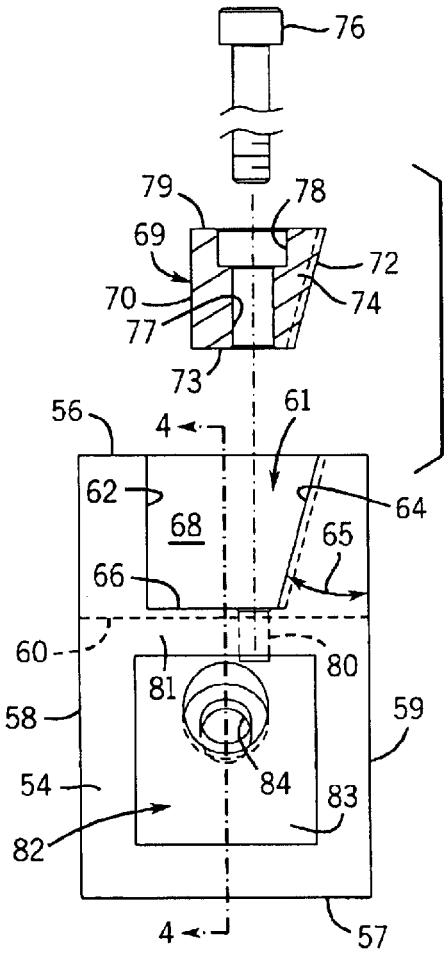
FIG. 3 is a front elevational exploded view of the clamping device of FIG. 2.
Figure 4:
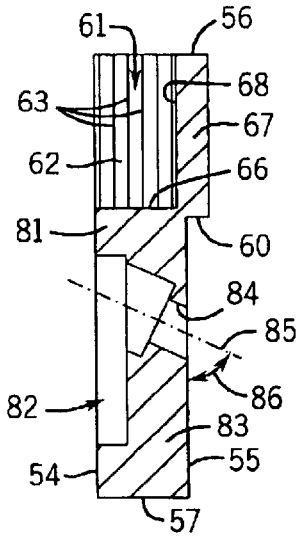
FIG. 4 is a sectional view taken along the plane of the line 4—4 in FIG. 3 of the clamp device.
Figure 12:
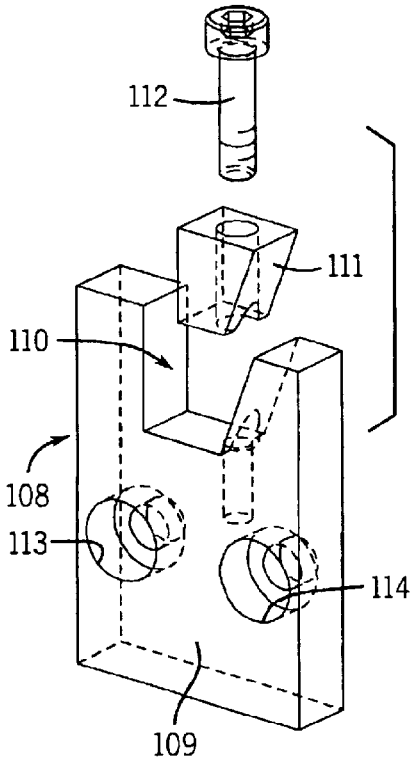
FIG. 12 PRIOR ART
FIG. 12 is a perspective exploded view illustrating a prior art clamp device for attaching a bar of the inner grid to the outer frame of the lower frame assembly for a blanking tool.
Figure 13:
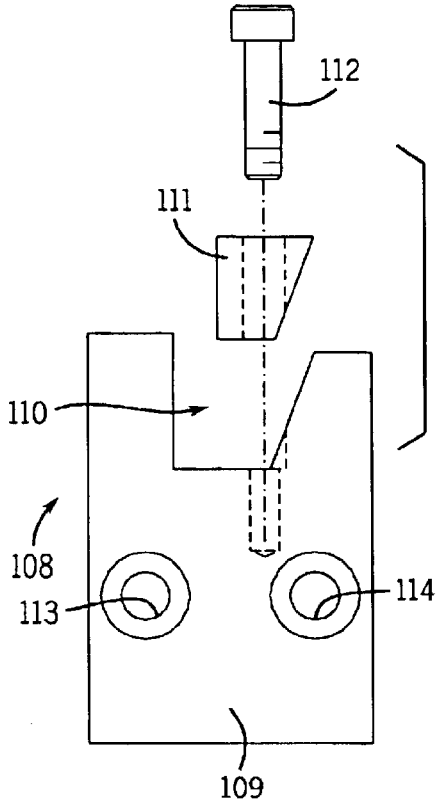
FIG. 13 PRIOR ART
FIG. 13 is a front elevational exploded view of the prior art clamp device of FIG. 12.

Clamp devices 13 of the present invention are illustrated in FIGS. 2–4. For comparison, a prior art clamp device 108 is illustrated in FIGS. 12 and 13. As illustrated, the prior art clamp device 108 includes an upright plate member 109, a U-shaped cavity 110 formed completely therethrough at its upper end, a wedge member 111 disposed within cavity 110 for sliding movement between a lower clamped position and an upper released position, and a screw member 112 extending vertically through wedge member 111 into plate member 109 for moving wedge member 111 between its clamped and released positions. Openings 113 and 114 extend transversely through the lower end of plate member 109 at a 90° angle to the faces of plate member 109 to receive bolts (not shown) for attaching the clamp device 108 to the rails of the lower frame assembly.

As illustrated in FIGS. 2–4, clamp device 13 of the present invention includes an upright plate member defining a substantially flat vertically extending inner face 54, a substantially flat opposite vertically extending outer face 55, a horizontally extending upper face 56, an opposite horizontally extending lower face 57, and a pair of opposite end faces 58 and 59. Together, faces 54–59 define a rectangular shape solid plate-like body composed of steel or aluminum. Although illustrated as having a height greater than either its length or width, clamp piece 13 may have other geometric shapes depending upon its end use.

A lip 60 is formed on the outer face 55 of clamp piece 13. Lip 60 projects substantially 90° with respect to outer face 55, and extends completely across face 55 to extend between end faces 58 and 59. Although illustrated as being located approximately two-thirds of the distance between upper face 56 and lower face 57, lip 60 could also be positioned slightly upwardly or downwardly from the location illustrated in FIG. 2. Also, lip 60 need not necessarily extend completely across face 55, but preferably does so to provide the maximum amount of clamp force against ledge 22 formed in cross rails 4 and 5.

A substantially U-shaped upper cavity or recess 61 is formed in inner face 54, and opens at its inner end to the inner face 54 and at its upper end to upper face 56. Cavity 61 defines an upper abutment surface 62 which extends vertically in a plane parallel to end faces 58 and 59, and is disposed at a 90° angle with respect to inner face 54. Abutment surface 62 as well as cavity 61 has a depth, i.e. extends into clamp device 13, approximately two-thirds of the distance between inner face 54 and outer face 55, and surface 62 includes a plurality of parallel vertically extending score lines 63 formed therein. Score lines 63 aid in providing friction to hold the outer ends of bars 11 of the inner grid, as will hereinafter be described. Cavity 61 also defines a downwardly sloped concave surface 64 disposed opposite of abutment surface 62 and at an acute angle 65 with respect to abutment surface 62. As illustrated best in FIG. 3, sloped surface 64 extends downwardly and away from end face 59 so that the lower end of cavity 61 is narrower than the upper end of cavity 61. Acute angle 65 is preferably between about 5° and about 45°, and most preferably about 15°. Finally, cavity 61 also defines a horizontally extending upper support surface 66. Surface 66 is substantially parallel to upper face 56 and extends 90° with respect to inner face 54. Cavity 61 is also defined by a rear wall 67. Rear wall 67 includes a rear surface 68 extending vertically in a plane parallel to inner face 54 and outer face 55.

An upper wedge member 69 is disposed within upper cavity 61 for sliding movement along the downwardly sloped surface 64 between a clamped position (i.e. at or toward the lower or narrower end of cavity 61) wherein the end of bar 11 is fixed in place, and a released position (i.e. at or toward the upper or wider end of cavity 61) wherein the bar 11 may be removed from cavity 61. As illustrated, wedge member 69 is substantially U-shaped in profile to substantially match the U-shaped profile of upper cavity 61. Wedge member 69 includes a vertically extending clamping surface 70 disposed in a plane parallel to and spaced from abutment surface 62. Clamping surface 70 also includes a plurality of parallel spaced score lines (not shown) formed therein for aiding in providing friction to hold bar 11 between surfaces 70 and 62. Wedge member 69 also includes a downwardly angled convex surface 72 disposed opposite clamping surface 70. Angled surface 72 functions to engage against and slide along downwardly sloped concave surface 64 of cavity 61 so as to move surface 70 of wedge member 69 into a position more closely adjacent to abutment surface 62 as wedge member 69 moves downwardly along surface 64. This action provides the clamping force necessary for clamping an end of a bar 11 between abutment surface 62 and clamping surface 70 as wedge member 69 moves downwardly into cavity 61. Concave surface 64 and convex surface 72 also function to capture or contain wedge member 69 and essentially lock it in position within cavity 61 so it does not laterally move therein as wedge member 69 moves downwardly to its clamping position. Wedge member 69 also includes a base surface 73 at its lower end disposed substantially parallel to support surface 63. Base surface 73 typically remains spaced from support surface 66 when the wedge member 69 is in its clamped position. Wedge member 69 also includes an inner substantially flat surface 74 disposed substantially flush with inner face 54, and an outer substantially flat surface 75 which bears against and slides along surface 68 of rear wall 67 as wedge member 69 moves between its clamped and released positions. As illustrated, rear wall 67 contains wedge member 69 within cavity 61, and it aids in properly locating wedge member 69 during assembly. Wall 67 also reinforces or stiffens the sides of clamp device 13 and prevents the upper end of cavity 61 from spreading apart as wedge member 69 moves downwardly to its clamping position.

As a means for moving upper wedge member 69 between its clamped and released positions, FIG. 2 illustrates a screw member 76 which extends vertically through wedge member 69 into support surface 66. Wedge 69 includes a bore 77 formed therethrough and opening to base surface 73 together with a counterbore 78 opening to top surface 79 so as to enable the head of screw 76 to be flush with surface 79 when wedge member 69 is in its clamped position. An internally threaded bore 80 is formed through a cross member 81 for receiving the externally threaded shank of screw 76. In this manner, as screw 76 is turned into threaded bore 80, wedge member 69 moves downwardly along surface 64 until clamping surface 70 engages one side of bar 11 and forces it against abutment surface 62. As screw 76 is tightened, additional clamping force is applied against bar 11 so as to rigidly clamp bar 11 between abutment surface 62 and clamping surface 70. To release bar 11, screw 76 is merely turned in a counterclockwise direction until wedge 69 moves away from bar 11 to release the clamping pressure applied thereto so that bar 11 can be removed from cavity 61.

In order to attach clamp device 13 to cross rails 4 and 5, a rectangular recess 82 is formed in inner face 54 to define a lower wall 83 separated by cross member 81 from upper cavity 61. A downwardly and outwardly extending bolt receiving bore 84 is formed through lower wall 83. Bore 84 defines an axis 85 disposed at an acute angle 86 with respect to outer face 55. The acute angle 86 may be anywhere between 1° and 89°, but is preferably between about 30° and about 80°, and is most preferably about 65° to match the angle 21 defined by slot 19 in cross rail 4. A bolt 87 extends through bore 84 into a nut (not shown) captured within slot 19. As bolt 87 is tightened, lip 60 is pulled tightly against ledge 22 of rail 4 while at the same time outer face 55 is forced to bear tightly against inner face 18 of cross rail 4 to rigidly hold clamp piece 13 in position on cross rail 4.

Figure 5:
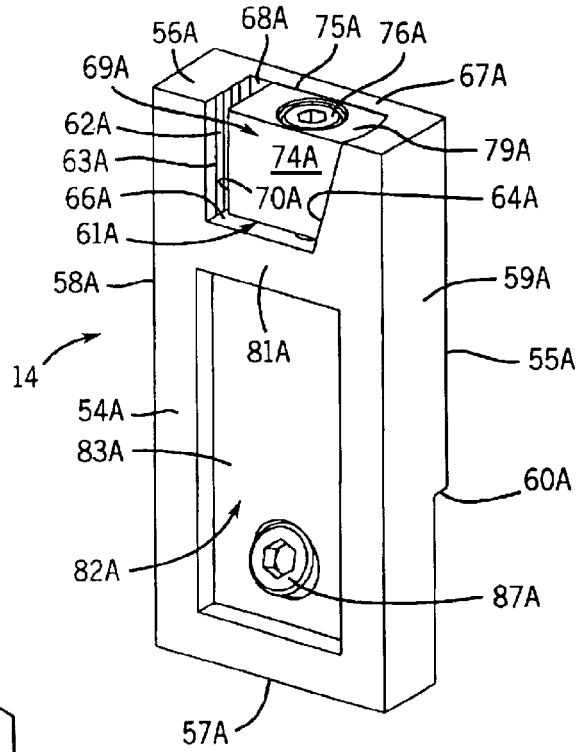
FIG. 5 is a perspective view illustrating a second embodiment of the clamp device of the present invention.
Figure 6:
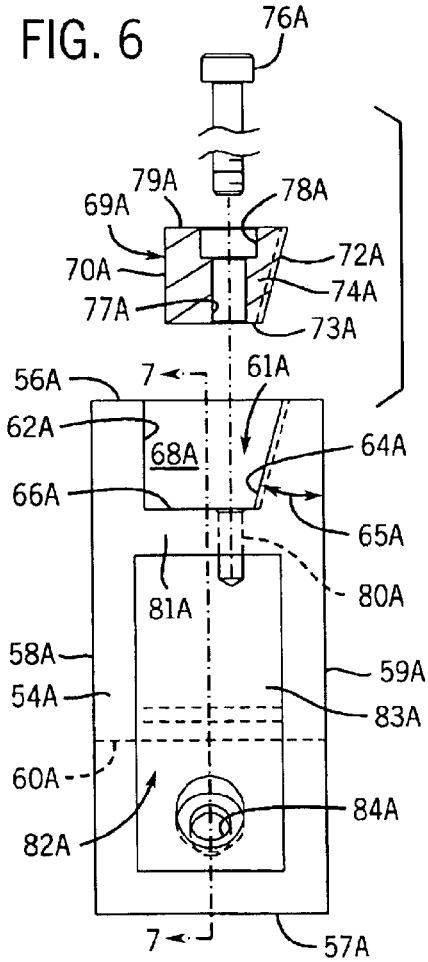
FIG. 6 is a front elevational exploded view of the clamp device of FIG. 5.
Figure 7:
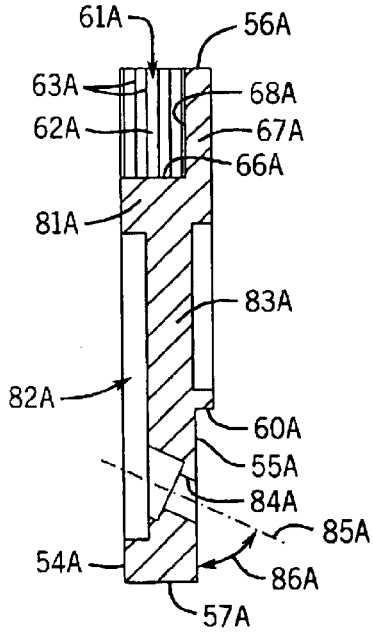
FIG. 7 is a sectional view taken along the plane of the line 7—7 in FIG. 6 of the clamp device illustrated therein.

Referring now to FIGS. 5–7, there is illustrated clamp devices 14 for attaching the ends of crosswise bars 12 to side rails 2 and 3. Clamp pieces 14 are identical to clamp pieces 13 with the exception that clamp pieces 14 are slightly taller than clamp pieces 12. Since clamp pieces 14 are substantially identical to clamp pieces 13, like numbers, except utilizing the designation "A" therewith, are utilized to refer to like parts or elements. It should be noted that lip 60A formed on outer face 55A of clamp piece 14 is located approximately one-third to one-half the distance between upper face 56A and lower face 57A thus enabling crosswise bars 12 to be spaced upwardly from side rails 2 and 3 at substantially the same height as lengthwise bars 11, as seen best in FIG. 1. Also, it should be noted that recess 82A is also substantially taller in clamp piece 14 than recess 82 is in clamp piece 13. In all other respects, clamp pieces 14 are substantially identical to clamp pieces 13, and need not be further described herein.

Figure 8:
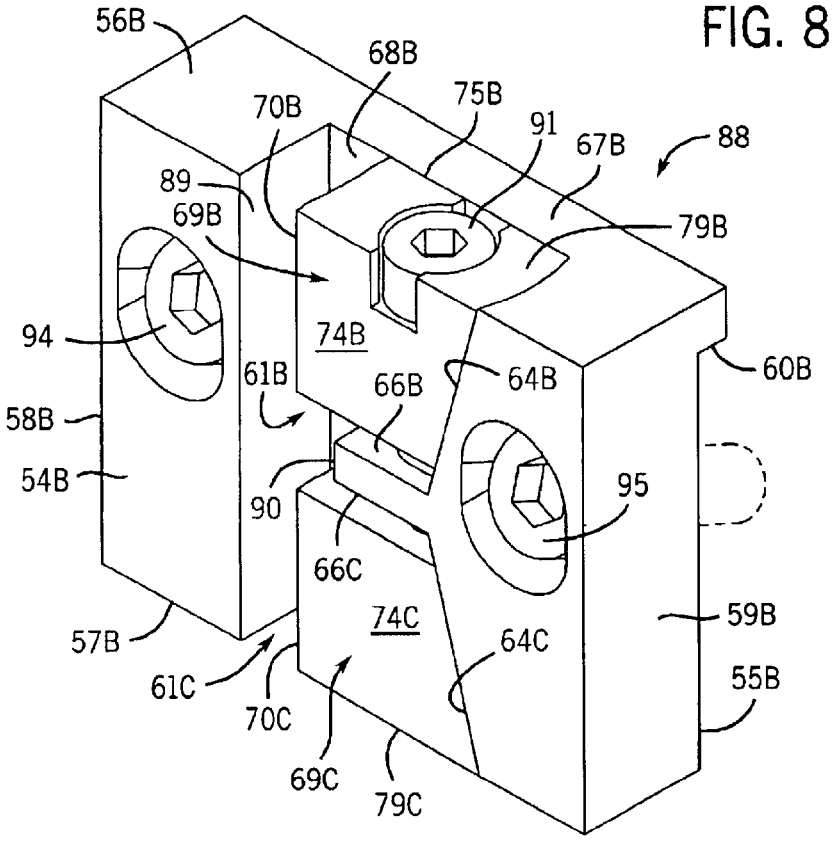
FIG. 8 is a perspective view illustrating a third embodiment of the clamp device of the present invention.
Figure 9:
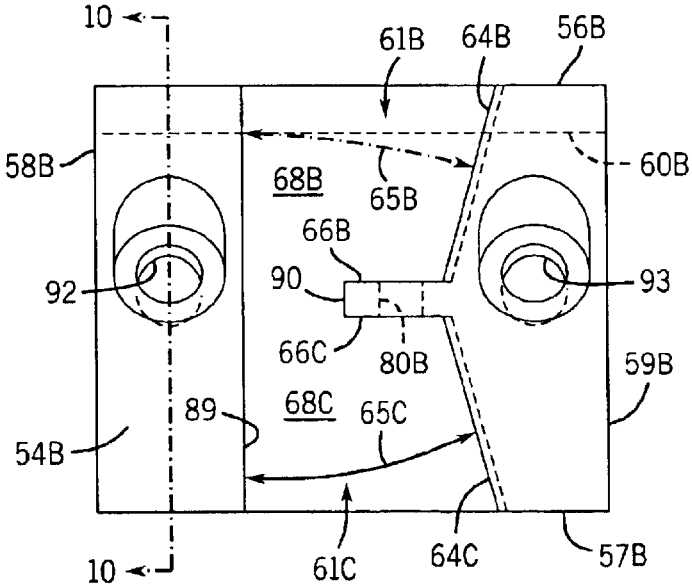
FIG. 9 is a front elevational view of the clamp device illustrated in FIG. 8 with the two clamping wedges removed.
Figure 10:
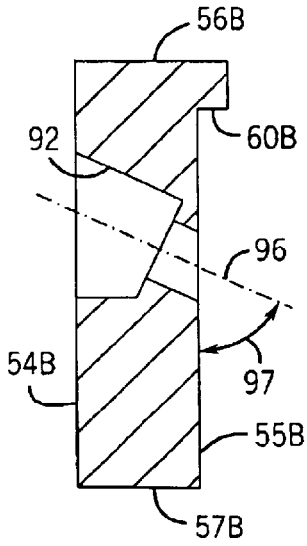
FIG. 10 is a sectional view taken along the plane in line 10—10 in FIG. 9 of the clamp device illustrated therein.

Referring now to FIGS. 8–10, there is illustrated a third embodiment of the clamp pieces of the present invention. This third embodiment is generally designated by the numeral 88, and as best shown in FIG. 8, provides a double clamping arrangement whereby the end of a rail or other component utilized with a lower blanking tool may be clamped securely in place on cross rails 4 or 5. Clamp piece 88 includes an upper wedge member 69B disposed within a U-shaped upper cavity 61B together with a lower wedge member 69C disposed within a lower U-shaped cavity 61C. Wedge members 69B and 69C as well as cavities 61B and 61C are identical to wedge member 69 and cavity 61 previously described herein with respect to FIGS. 2–4. Since the components of clamp piece 88 are substantially identical to the components of clamp pieces 13 and 14 previously described herein, like numbers, except utilizing the designation "B" for the upper components and "C" for the lower components, are utilized in FIGS. 8–10 to refer to like parts or elements. The only significant differences between clamp piece 88 and clamp pieces 13 and 14 previously described herein is that abutment surface 89 forms a continuous uninterrupted abutment surface extending between upper face 56B and lower face 57B. In addition, cross member 81B does not extend completely to abutment surface 89, but instead has an end face 90 which is spaced from abutment surface 89. Additionally, lip 60B is formed at upper face 56B and is contiguous therewith rather than being located between upper face 56B and lower 57B as for clamp pieces 13 and 14. Lastly, this third embodiment includes a single screw 91 which simultaneously moves upper wedge 69B and lower wedge 69C to their clamped positions as it is turned down in a clockwise direction. In order to accomplish this, screw 91 extends vertically into upper wedge 69B, through cross member 81B and vertically through lower wedge member 69C. Thus, as screw 91 is turned in a clockwise direction, lower wedge 69C is pulled upwardly along the upwardly sloped surface 64C while upper wedge 69B is pushed downwardly along downwardly sloped surface 64B until their respective clamping surface 70C and 70B engage and hold a component against abutment surface 89. To release the component, screw 91 is merely turned in a counterclockwise direction so that upper wedge 69B moves upwardly and lower wedge 69C moves downwardly away from abutment surface 89.

Clamp piece 88 also includes a pair of aligned outwardly and downwardly extending bolt-receiving bores 92 and 93 formed therethrough through which bolts 94 and 95 extend into the T-shaped slots of rails 4 or 5. Each bore 92, 93 defines an axis 96 disposed at an acute angle 97 with respect to the outer face 55B of clamp piece 88, as shown best in FIG. 10. Acute angle 97 may be anywhere between 1° and 89°, but is preferably about 30° to about 80°, and is most preferably about 65° to match the angles of the T-shaped slots. Thus, as bolts 94 and 95 are turned clockwise, they engage nuts (not shown) contained in the T-shaped slot of rails 4 or 5. As bolts 94 and 95 are tightened, they engage the nuts to pull clamp piece 88 so that its outer face 55B tightly engages the inner face of the rail. In this manner, clamp piece 88 is rigidly connected to a rail 4 or 5 so that lip 60B engages the ledge 22 formed in cross rail 4 or cross rail 5.

Referring now to FIG. 11, there is illustrated a stiffening assembly for one or both of side rails 2 and 3. As illustrated, the stiffening assembly comprises a longitudinally extending angle member 98 having a length substantially the same as the length of side rail 2 or side rail 3. Angle member 98 includes a horizontal leg 99 and a vertical leg 100 disposed at 90° to one another. Angle member 98 may be composed of any suitable material, but is preferably steel having sufficient strength to stiffen the aluminum side rails 2 or 3. As illustrated, vertical leg 100 has a longitudinally extending V-shaped groove 101 formed therein. The opposite side of leg 100 defines a planar face which bears or abuts against the outer face 55A of clamp pieces 13, as illustrated. Clamp pieces 13 each include a V-shaped cut 102 formed horizontally across its outer face 55A. The stiffening assembly also includes a C-shaped jaw 103 having a pair of opposite parallel legs 104, 105 with leg 105 being slightly longer than leg 104 and the terminal ends of which are rounded for engagement within V-shaped groove 101 and V-shaped cut 102. To complete the assembly, a screw 106 extends through wall 107 of C-shaped jaw 103 into clamp piece 13. Thus, as screw 106 is turned down in a clockwise direction, jaw 103 is moved toward clamp piece 13 so that leg 104 engages V-shaped groove 101 and leg 105 engages V-shaped cut 102 until angle member 98 is rigidly in place. As a result, angle member 98 stiffens side rail 2 or 3 to prevent any significant flexing thereof during a blanking operation.

I claim:

1. A clamp device for attaching bars of an inner grid to an outer frame for a lower blanking tool of a carton die cutting machine, comprising:

an upright plate member defining a substantially flat vertically extending inner face, a substantially flat opposite vertically extending outer face, and a horizontally extending upper face, the plate member including an outwardly and downwardly extending bolt-receiving bore formed therethrough, said bore defining an axis disposed at an acute bore angle with respect to the outer face;

a substantially U-shaped upper cavity formed in the inner face of said plate member and opening at its inner end to said inner face and at its upper end to said upper face, said upper cavity defining a vertically extending upper abutment surface, an opposite downwardly sloped surface disposed at an acute surface angle with respect to said upper abutment surface, an upper support surface, and a rear surface extending vertically in a plane parallel to the inner and outer faces of said upright plate member;

an upper wedge member disposed within said upper cavity for sliding movement along said downwardly sloped surface between clamped and released positions, said upper wedge member being substantially U-shaped and defining a clamping surface disposed parallel to and spaced from said upper abutment surface, an opposite downwardly sloped surface, and a base surface spaced from said upper support surface in said clamped position; and screw means for moving said upper wedge between said clamped and released positions.

2. The clamp device of claim 1 wherein said acute surface angle is between about 5° and about 45°.

3. The clamp device of claim 1 wherein said acute surface angle is about 15°.

4. The clamp device of claim 1 wherein said screw means for moving said wedge comprises a fastener extending vertically through said wedge member parallel to said clamping surface and into said support surface.

5. The clamp device of claim 1 wherein the acute bore angle of said bore is between about 30° to about 80°.

6. The clamp device of claim 1 wherein the acute bore angle of said bore is about 65°.

7. A frame assembly for a lower blanking tool of a carton die cutting machine, comprising:

a rigid outer frame;

an inner grid comprised of a plurality of lengthwise and crosswise extending bars; and a plurality of clamps attaching said bars to said outer frame, each clamp comprising:

an upright plate member defining a substantially flat vertically extending inner face, a substantially flat opposite vertically extending outer face, and a horizontally extending upper face, the plate member including an outwardly and downwardly extending bolt-receiving bore formed therethrough, said bore defining an axis disposed at an acute bore angle with respect to said outer face;

a substantially U-shaped upper cavity formed in the inner face of said plate member and opening at its inner end to said inner face and at its upper end to said upper face, said upper cavity defining a vertically extending upper abutment surface, an opposite downwardly sloped surface disposed at an acute surface angle with respect to said upper abutment surface, an upper support surface, and a rear surface extending vertically in a plane parallel to the inner and outer faces of said upright plate member;

an upper wedge member disposed within said upper cavity for sliding movement along said downwardly sloped surface between clamped and released positions, said upper wedge member being substantially U-shaped and defining a clamping surface disposed parallel to and spaced from said upper abutment surface, an opposite downwardly angled surface disposed to engage against and slide along said downwardly sloped surface, and a base surface spaced from said upper support surface in said clamped position; and screw means for moving said upper wedge between said clamped and released positions.

8. The frame assembly of claim 7 wherein said acute surface angle is between about 5° and about 45°.

9. The frame assembly of claim 7 wherein said acute surface angle is about 15°.

10. The frame assembly of claim 7 wherein said screw means for moving said wedge comprises a fastener extending vertically through said wedge member parallel to said clamping surface and into said support surface.

11. The frame assembly of claim 7 wherein the acute bore angle of said bore is between about 30° to about 80°.

12. The frame assembly of claim 7 wherein the acute bore angle of said bore is about 65°.

13. The frame assembly of claim 7 further including a bolt extending through said bore into said outer frame.

14. The frame assembly of claim 7 wherein said outer frame includes a pair of opposite spaced apart longitudinally extending side rails and further including a stiffening assembly for at last one of said side rails comprising a longitudinally extending angle member, one leg of said angle member having a groove formed therein, and at least two of said clamps each include a cut formed horizontally across its outer face, a C-shaped jaw for engaging said groove and cut, and a screw extending through said jaw into said upright plate member.

15. The frame assembly of claim 14 wherein said groove is V-shaped.

16. The frame assembly of claim 14 wherein said cut is V-shaped.

* * * * *